US005812990A

United States Patent [19]

Ryan, Jr. et al.

[11] Patent Number: 5,812,990

[45] Date of Patent: Sep. 22, 1998

[54] SYSTEM AND METHOD FOR PROVIDING AN ADDITIONAL CRYPTOGRAPHY LAYER FOR POSTAGE METER REFILLS

[75] Inventors: Frederick W. Ryan, Jr., Oxford; Robert W. Sisson, Shelton, both of Conn.

[73] Assignee: Pitney Bowes Inc., Stamford, Conn.

[21] Appl. No.: 773,537

[22] Filed: Dec. 23, 1996

[51] Int. Cl.[6] ..... G07B 17/02

[52] U.S. Cl. ..... 705/403; 235/375; 235/380; 235/382.5; 340/825.3; 340/825.35

[58] Field of Search ..... 235/375, 379, 235/380, 381, 382, 382.5; 340/825.3, 825.35; 364/400; 380/21, 23, 24; 705/400, 403, 410; 902/2

[56] References Cited

U.S. PATENT DOCUMENTS

| | | | |
|---|---|---|---|
| 3,792,446 | 2/1974 | McFiggins et al. | 705/403 |
| 4,097,923 | 6/1978 | Eckert, Jr. et al. | 705/403 |
| 4,376,299 | 3/1983 | Rivest | 380/23 |
| 4,447,890 | 5/1984 | Duwel et al. | 705/403 |
| 4,837,701 | 6/1989 | Sansone et al. | 705/404 |
| 4,853,864 | 8/1989 | Hart et al. | 705/403 |
| 4,947,333 | 8/1990 | Sansone et al. | 705/403 |
| 4,962,454 | 10/1990 | Sansone et al. | 705/408 |
| 5,077,660 | 12/1991 | Haines et al. | 705/410 |
| 5,077,792 | 12/1991 | Herring | 380/24 |
| 5,224,046 | 6/1993 | Kim et al. | 705/403 |
| 5,233,531 | 8/1993 | Schulz | 705/403 |
| 5,237,506 | 8/1993 | Horbal et al. | 705/403 |
| 5,369,401 | 11/1994 | Haines | 705/403 |
| 5,369,707 | 11/1994 | Follendore | 380/25 |
| 5,544,086 | 8/1996 | Davis et al. | 364/408 |
| 5,612,884 | 3/1997 | Haines | 705/403 |
| 5,638,442 | 6/1997 | Gargiulo et al. | 380/21 X |

*Primary Examiner*—Edward R. Cosimano
*Attorney, Agent, or Firm*—Charles R. Malandra, Jr.; Melvin J. Scolnick

[57] ABSTRACT

A system and method is provided for refilling a postage metering system that includes a host coupled to a postal security device (PSD). A user enters a first request for postage refill which is transmitted to a meter server. The meter server transmits a request for a PSD audit to the postage metering system. PSD audit data is signed with a first secret key stored in the PSD to produce an audit message that includes a first signature and the PSD audit data. The audit message is transmitted to the meter server which transmits the first signature to a key management system which then verifies the first signature using a second secret key stored in the key management system. The PSD audit data is verified at the meter server which then constructs a second request for meter refill and transmits it to a meter recharging data center. The meter recharging data center generates a refill combination and transmits it to the meter server. The refill combination is transmitted from the meter server to the key management system for signature using the second secret key to produce a refill message that is transmitted to the meter server. The refill message includes a second signature and the refill combination. The refill message is transmitted to the PSD which verifies the signature and the refill combination using the first secret key and credits the PSD for the amount.

13 Claims, 3 Drawing Sheets

SYSTEM AND METHOD FOR PROVIDING AN ADDITIONAL CRYPTOGRAPHY LAYER FOR POSTAGE METER REFILLS

FIELD OF THE INVENTION

The present invention relates generally to a system and method for remote resetting of postage meters and similar systems and, more particularly, to the security of such remote resetting.

BACKGROUND OF THE INVENTION

The Information-Based Indicia Program (IBIP) is a distributed trusted system proposed by the United States Postal Service (USPS). The IBIP is expected to support new methods of applying postage in addition to, and eventually in lieu of, the current approach, which typically relies on a postage meter to mechanically print indicia on mailpieces. The IBIP requires printing large, high density, two dimensional (2-D) bar codes on mailpieces. The Postal Service expects the IBIP to provide cost-effective assurance of postage payment for each mailpiece processed.

The USPS has published draft specifications for the IBIP. The INFORMATION BASED INDICIA PROGRAM (IBIP) INDICIUM SPECIFICATION, dated Jun. 13, 1996, defines the proposed requirements for a new indicium that will be applied to mail being processed using the IBIP. The INFORMATION BASED INDICIA PROGRAM POSTAL SECURITY DEVICE SPECIFICATION, dated Jun. 13, 1996, defines the proposed requirements for a Postal Security Device (PSD) that will provide security services to support the creation of a new "information based" postage postmark or indicium that will be applied to mail being processed using the IBIP. The INFORMATION BASED INDICIA PROGRAM HOST SYSTEM SPECIFICATION, dated Oct. 9, 1996, defines the proposed requirements for a host system element of the IBIP. The specifications are collectively referred to herein as the "IBIP Specifications". The IBIP includes interfacing user (customer), postal and vendor infrastructures which are the system elements of the program.

The IBIP PSD Specification requires a signature of each request for an automatic remote refill, i.e., resetting or recharging, of postal value to a PSD. The Specification also requires that certain data elements be included.

Various schemes have been devised and implemented to obtain a desired remote recharging of a postage meter based on information from a remote data processing center. Typical postage meter refill systems and methods do not include all of the required data elements and do not include a signature of the request for refill.

A system for the remote resetting of postage meters is marketed by the assignee of the present application under the trademark "Postage By Phone" and is described in U.S. Pat. No. 4,097,923. Briefly stated, the recharging process includes an operator obtaining an "access code" from the meter. This code represents an encryption of at least a "control sum" and meter serial number, where the control sum corresponds to the total amount of funds with which the meter has been charged to date. This access code is generated by the meter and may be read from the meter display upon operator request. The operator then communicates the access code, the amount by which the meter is to be recharged, an account number against which the recharge amount is to be debited, and the meter identification number to a remote data processing center. At the data processing center the access code is validated and a "combination code" (also known as a "recharge code") is generated as a function of at least the amount by which the meter is to be recharged and the meter identification number. This recharge code is communicated to the operator who enters the amount together with the recharge code into the postage meter through its keyboard. The postage meter then validates the recharge code and increments a descending register of the meter by the amount requested. It is well known in the postage meter art that the descending register of a postage meter is decremented by the amount of postage dispensed, and an ascending register is incremented by this same amount, each time the meter prints an indicium. The control sum is thus the sum of the contents of the descending and ascending registers. The meter is designed so that it will not print postage if sufficient funds are not available in the descending register.

Variations to the Postage By Phone remote recharging system are described in various U.S. patents. For example, in U.S. Pat. No. 5,224,046, a system for obtaining recharge codes for one or more postage meters includes a conventional microcomputer that is connected through a modem to a remote data processing center. In U.S. Pat. No. 5,233,531 the request for recharge of a postage meter is transmitted through a facsimile communication.

The IBIP requirements would require a remote recharging infrastructure that is different than the typical systems that are presently in use. Furthermore, implementation of the proposed IBIP requirements would result in the PSD master key being used for multiple purposes, i.e. for the generation of verification tokens and for the signature of the recharging request. Such multiple uses of cryptographic keys are discouraged in cryptographic systems because of the potential compromise to the security of the system.

SUMMARY OF THE INVENTION

It has been found that the present invention enables the use of existing infrastructure of a recharging system and also avoids multiple use of the PSD master key. Furthermore, the present invention increases the security in automatic remote resetting transactions. The present invention meets the USPS objectives set forth in the IBIP Specifications without the need for a more complicated infrastructure or for the multiple use of the PSD master key. The present invention does this by adding a cryptographic layer to an existing proven infrastructure, such as Postage By Phone.

The Postal Security Device (PSD) will have a secret key (Triple DES, RC2, RC4 etc.) installed during the manufacturing initialization phase. This key will be used to provide the additional cryptographic layer during Postage By Phone transactions.

The present invention provides a system and method for refilling a postage metering system that includes a host coupled to a postal security device (PSD). A user enters a first request for postage refill which is transmitted to a meter server. The meter server transmits a request for a PSD audit to the postage metering system. PSD audit data is signed with a first secret key stored in the PSD to produce an audit message that includes a first signature and the PSD audit data. The audit message is transmitted to the meter server which transmits the first signature to a key management system which then verifies the first signature using a second secret key stored in the key management system. The PSD audit data is verified at the meter server which then constructs a second request for meter refill and transmits it to a meter recharging data center. The meter recharging data center generates a refill combination and transmits it to the meter server. The refill combination is transmitted from the meter server to the key management system for signature using the second secret key to produce a refill message that is transmitted to the meter server. The refill message includes a second signature and the refill combination. The refill message is transmitted to the PSD which verifies the signature and the refill combination using the first secret key and credits the PSD for the amount.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1:
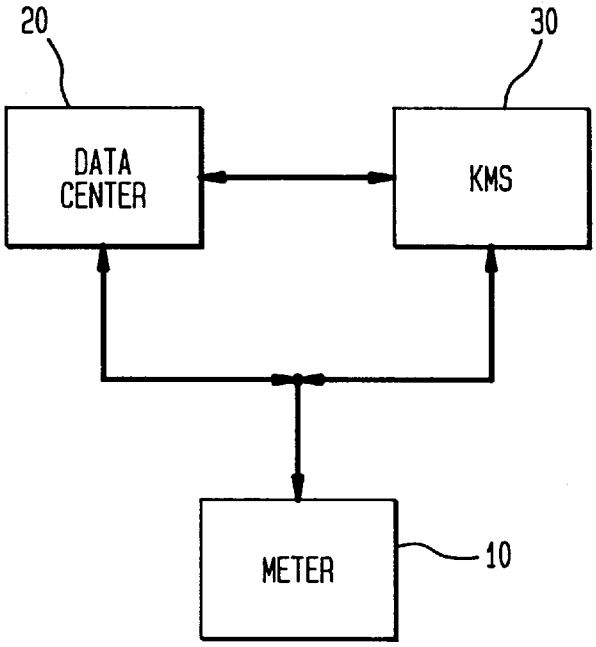
FIG. 1 (PRIOR ART)
FIG. 1 is a schematic block diagram of a prior art system for a remote meter recharging of a postage meter.

In describing the present invention, reference is made to the drawings, wherein there is seen in FIG. 1 a schematic block diagram of a prior art system for a remote meter recharging system (also known as RMRS). The system includes a conventional electronic postage meter 10, including a microcomputer, keyboard, display and memory, which is connected through a modem to a remote data processing center 20. The center 20 provides codes to recharge the meter 10. In an alternate configuration (not shown), as described in U.S. Pat. No. 5,224,046, the meter is coupled to a conventional personal computer system which is connected through a modem to the remote data processing center. A Key Management System 30 generates, manages and distributes cryptographic keys. When a new meter 10 is put in service the Key Management System 30, through a key distribution system, gives the necessary keys to the meter 10.

Figure 2:
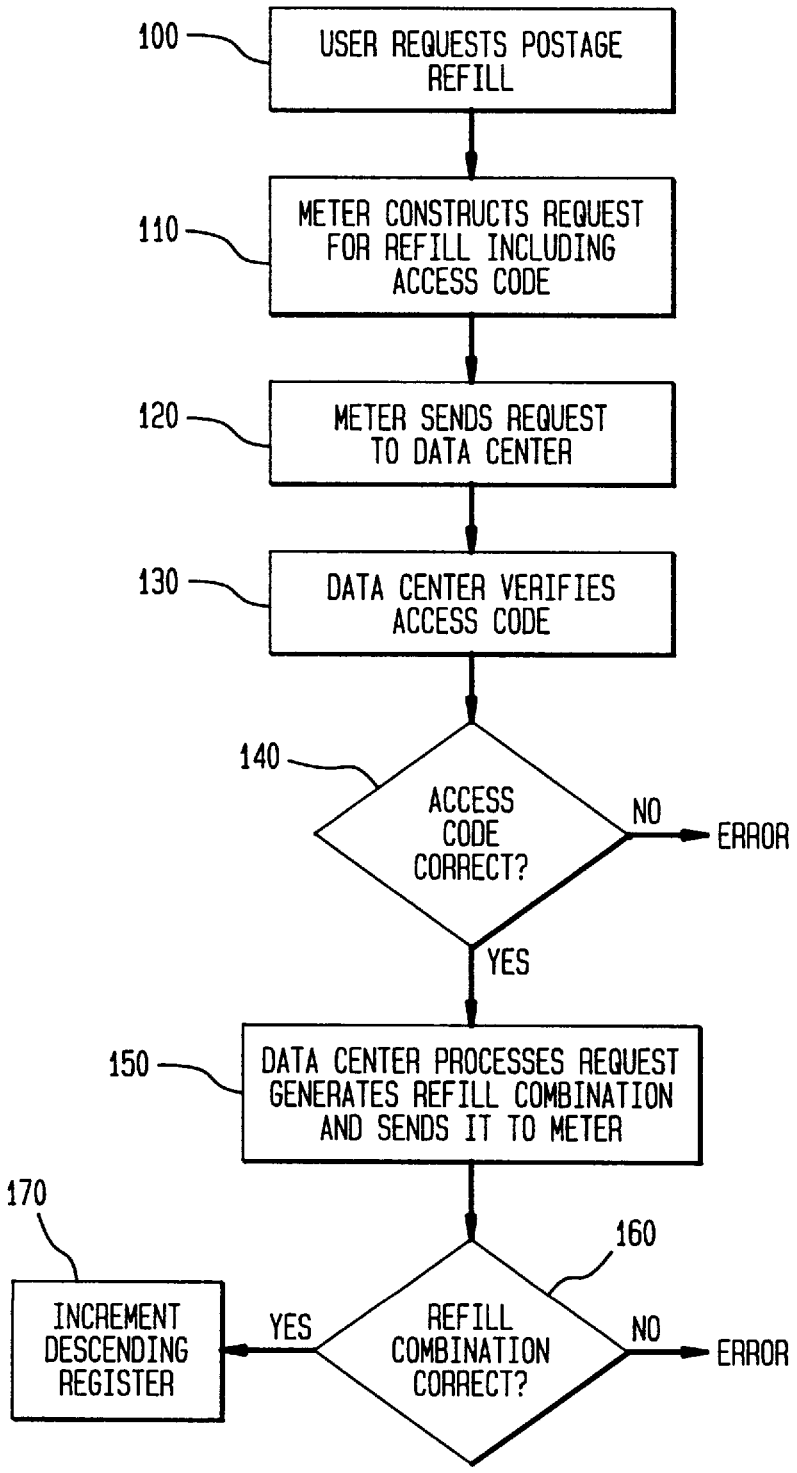
FIG. 2 (PRIOR ART)
FIG. 2 is a flow chart of the remote recharging process of the prior art system of FIG. 1.

Referring now to FIG. 2, there is shown a typical process to recharge postage meters for the prior art system of FIG. 1. At step 100, a user initiates a meter recharge request for a specific amount by entering through the keyboard certain information, including the specific amount, and customer account number. At step 110, the meter constructs a request for meter refill including an access code. At step 120, the meter then forwards the request to the remote data processing center. At step 130, the remote data center verifies the access code. If not correct, at step 140, an error is flagged. If correct, the remote data center, at step 150, processes the request and generates a refill combination that is unique for the requesting meter, and sends the refill combination to the meter. At step 160, the meter verifies that the refill combination is correct. If correct, at step 170, the descending register of the meter is incremented in the amount of the requested postage. If not correct an error is flagged.

In accordance with the present invention, a module is added to a typical remote meter recharging system, such as the Pitney Bowes Postage By Phone system. The module interfaces with the Key Management System and the postage meter. In the preferred embodiment of the present invention, the added module is a meter server. In an alternate embodiment, a software module, which is added to the existing remote meter recharging computer system in lieu of the separate Meter Server, performs the same functions as the Meter Server but in the remote meter recharging computer system.

Figure 3:
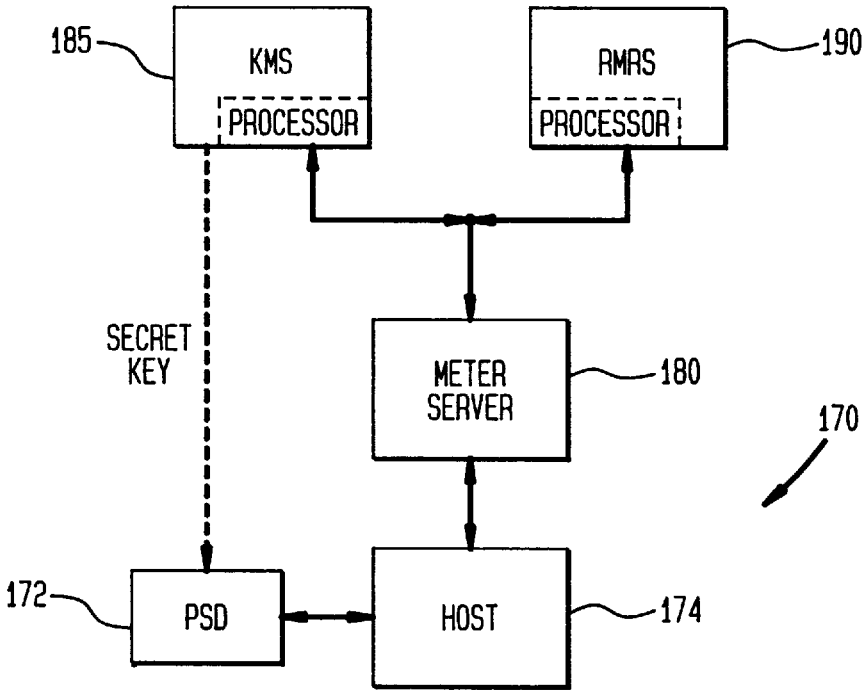
FIG. 3 is a schematic block diagram of a remote meter recharging system in accordance with the present invention.

Referring now to FIG. 3, a schematic block diagram of a postage evidencing system which includes a remote meter recharging system in accordance with the present invention is shown. The postage evidencing part of the system, generally designated 170, comprises a postal security device (PSD) 172 coupled to a host system 174, which may be a conventional computer system or a postage meter. The PSD 172 is a secure processor-based accounting device that dispenses and accounts for postal value stored therein. The host 174 is conventionally connected to a remote Meter Server 180 which establishes on-line connections to several other computer systems, such as a Key Management System 185 and a Remote Meter Recharging System 190. The Key Management System 185 generates, manages and distributes cryptographic keys and handles obtaining meter certificates. When a new PSD 172 is put in service the Key Management System 185, through a key distribution system, gives the necessary keys to the Meter Server 180 so it can process meter refills and audits.

During manufacturing initialization of a PSD 172 the Key Management System 130 provides a secret key to the PSD 172. The secret key may be unique to the PSD, or, preferably, is a key from a "1000 Key System." as described in U.S. patent application Ser. No. 08/742,526, filed Nov. 1, 1996, and U.S. patent application Ser. No. 08/133,416, filed Oct. 8, 1993, both assigned to the assignee of the instant application. The secret key, which is stored in an encrypted format in the KMS database, is loaded from the secure KMS system in a manner similar to that described in U.S. patent application Ser. No. 08/553,812, filed Oct. 23, 1995 and assigned to the assignee of the instant application.

When the PSD performs a remote meter recharging transaction it signs the data portion of its recharge request message using the secret key. The Key Management System 185 is preferably located at the same location as the Meter Server 180 and is directly connected to the Meter Server computer system. The Meter Server 180 may be located at the Remote Meter Recharging Data Center, also known as the Vendor Data Center.

Figure 4:
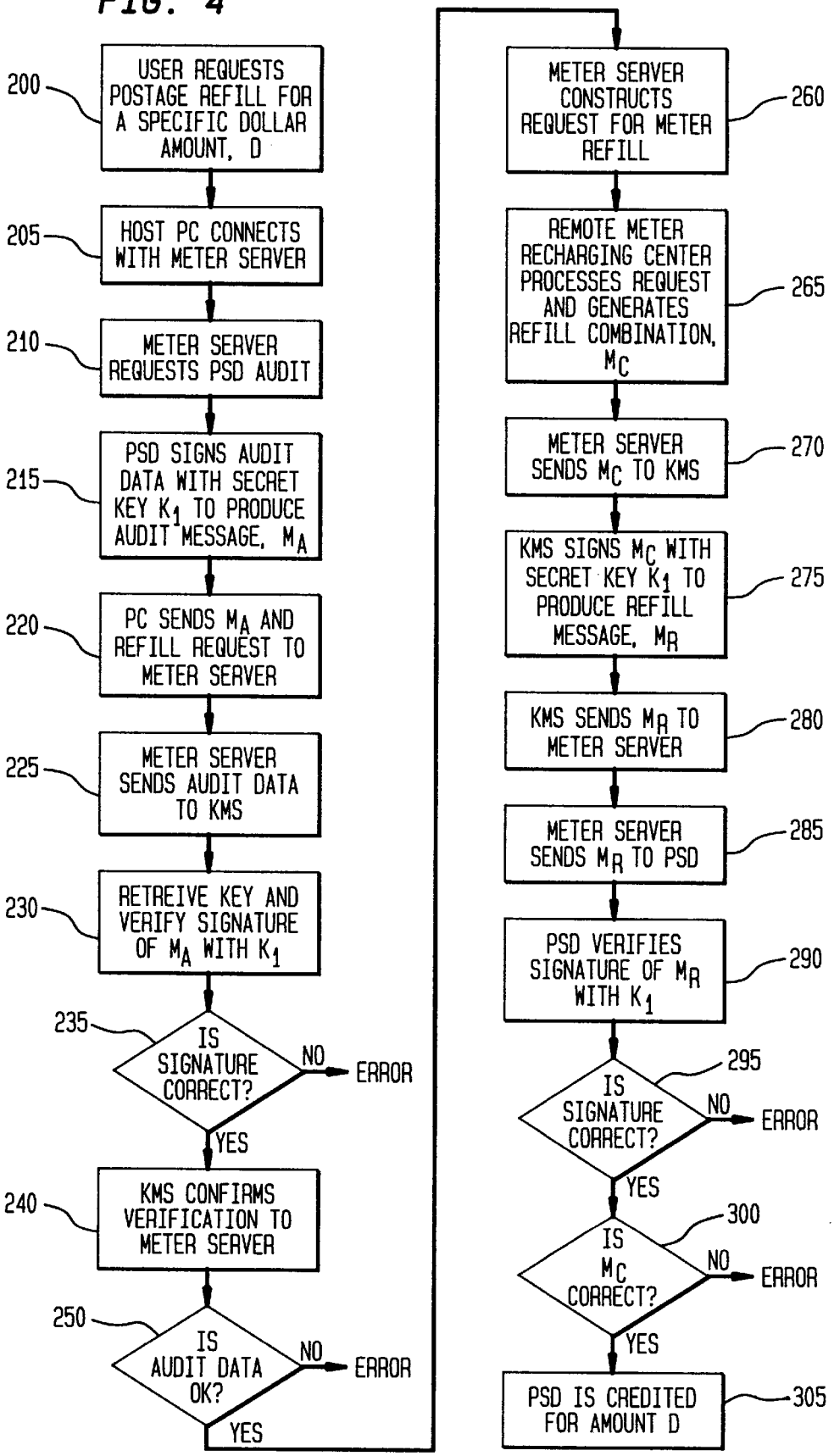
FIG. 4 is a flow chart of the remote recharging process of the remote meter recharging system of FIG. 3 in accordance with the present invention.

Referring now to FIG. 4, the remote recharging process in accordance with the present invention is described. At step 200, a user requests a postage refill for a specified dollar amount D. The host, at step 205, connects with the Meter Server which then requests, at step 210, a PSD audit. At step 215, the PSD signs audit data with its secret key $K_1$ to produce an audit message $M_A$. Audit data minimally includes PSD ID, control sum and ascending or descending register, but may also include: number of previous refills, piece count or other PSD related data. It is noted that a typical remote meter recharging system, such as the Pitney Bowes Postage By Phone system, sends just a code representing the audit data.

At step 220 the host sends the signed audit message $M_A$ and the refill request to the Meter Server. The Meter Server, at step 225, sends the signed audit data to the Key Management System, which, at step 230, retrieves the appropriate secret key $K_1$ from its database and verifies the signature of audit message $M_A$ using the secret key $K_1$. If the signature is correct, at step 235, the Key Management System, at step 240, confirms the verification to the Meter Server. If the signature is not correct, then an error signal is sent from the Key Management System to the Meter Server which in turn sends the error signal to the PSD. If the signature has been verified, then, at step 250, the Meter Server checks the audit data. If the data is not complete or is not consistent with prior audits or verifications for the meter, an error is flagged. If the audit data is acceptable, the Meter Server, at step 260, constructs a request for meter refill and sends it to the Remote Meter Recharging Center.

At step 265, the Remote Meter Recharging Center processes the request and generates a refill combination $M_C$ and sends it to the Meter Server. At step 270, the Meter Server sends the refill combination $M_C$ to the Key Management System for signature. The Key Management System, at step 275, signs the refill combination $M_C$ with the secret key $K_1$ to produce a refill message $M_R$. At step 280, the Key Management System sends the signed refill message $M_R$ to the Meter Server, which, at step 285, sends the signed refill message $M_R$ to the PSD. At step 290, the PSD verifies the signature of refill message $M_R$ using the secret key $K_1$. If the signature is correct, at step 295, the PSD then determines, at step 300, if the refill combination $M_C$ is correct. If the refill combination $M_C$ is correct then, at step 305, the PSD is credited for the requested amount D. If either the signature or the refill combination $M_C$ is not correct, an appropriate error is flagged.

It is noted that request and combination codes are calculated as described in U.S. Pat. Nos. 4,097,923, 5,224,046 and 5,233,531, which are incorporated herein for the purpose of describing such calculations. It is further noted that in the preferred embodiment of the present invention, the process has been described with the messages being signed. It will be understood by those skilled in the art that the process will work as well with the messages being encrypted and decrypted rather than being signed. It is also noted that although the preferred embodiment of the present invention is described using secret key cryptography, public key cryptography could be used as well.

Finally, it has been found that physically separating where the refill combination is generated and where it is signed adds to the security of the system. By separating the processes required to generate a valid refill message, the system is protected from a single point compromise.

While the present invention has been disclosed and described with reference to a single embodiment thereof, it will be apparent, as noted above, that variations and modifications may be made therein. It is, thus, intended in the following claims to cover each variation and modification that falls within the true spirit and scope of the present invention.

What is claimed is:

1. A method for refilling a postage metering system comprising a host coupled to a postal security device (PSD), the method comprising the steps of:

entering through the host a first request for postage refill including an amount the postage metering system is to be refilled;

transmitting said request for postage refill to a meter server;

signing PSD audit data with a first key stored in the PSD to produce an audit message, said audit message including a first signature and said PSD audit data;

transmitting said audit message to said meter server;

verifying said first signature using a second key;

verifying said PSD audit data at said meter server;

transmitting a second request for meter refill from said meter server to a meter recharging data center;

generating a refill combination at said meter recharging data center in response to said second request for meter refill;

transmitting said refill combination to said meter server;

signing said refill combination using a third key to produce a refill message, said refill message including a second signature and said refill combination, transmitting said refill message to said PSD;

verifying said signature and said refill combination using a fourth key; and crediting said PSD for said amount when said second signature and said refill combination are verified.

2. The method of claim 1 wherein the step of transmitting said refill message to said PSD comprises the steps of:

transmitting said refill message to said host; and transmitting refill message from said host to said PSD.

3. The method of claim 1 comprising the further step of:

generating an error signal when said first signature is not verified.

4. The method of claim 1 comprising the further step of:

generating an error signal when said PSD audit data is not verified by said meter server.

5. The method of claim 1 comprising the further step of:

generating an error signal when at least one of said signature and said refill combination are not verified by said PSD.

6. The method of claim 1 wherein said first and second keys are identical.

7. The method of claim 1 wherein said third and fourth keys are identical.

8. The method of claim 1 wherein said first and second keys are a public key pair.

9. The method of claim 1 wherein said third and fourth keys are a public key pair.

10. The method of claim 1 comprising the further step of:

transmitting a request for a PSD audit from said meter server to the postage metering system.

11. A system for refilling a postage metering system comprising a host coupled to a postal security device (PSD), the system comprising:

a meter server operatively coupled to the postage metering system for receiving a meter refill request message therefrom and for transmitting a refill message thereto;

a meter refilling data center operatively coupled to the postage metering system, said meter refilling data center including means for generating a refill combination in response to a request for meter refill received from said meter server; and a key management system operatively coupled to said meter server, said key management system having stored therein a first key corresponding to a second key stored in the PSD, wherein said key management system verifies a first signature in said refill request message received by said meter server from the postage metering system, and wherein said key management system signs said refill combination to produce said refill message.

12. A method for refilling a postage metering system comprising a host coupled to a postal security device (PSD), the method comprising the steps of:

entering through the host a first request for postage refill including an amount the postage metering system is to be refilled, transmitting said request for postage refill to a meter server, receiving said request for postage refill at said meter server, transmitting a request for a PSD audit from said meter server to the postage metering system;

signing PSD audit data with a first key stored in the PSD to produce an audit message in response to said request for a PSD audit, said audit message including a first signature and said PSD audit data;

transmitting said audit message to said meter server;

transmitting said first signature to a key management system;

verifying said first signature at the key management system using a second key stored in the key management system;

verifying said PSD audit data at said meter server;

constructing a second request for meter refill at said meter server;

transmitting said second request for meter refill to a meter recharging data center;

generating a refill combination at said meter recharging data center in response to said second request for meter refill;

transmitting said refill combination to said meter server;

transmitting said refill combination from said meter server to said key management system;

signing said refill combination using a third key to produce a refill message at said key management system and transmitting said refill message to said meter server, said refill message including a second signature and said refill combination;

transmitting said refill message to said PSD;

verifying said signature and said refill combination using a fourth key; and crediting said PSD for said amount when said second signature and said refill combination are verified.

13. The method of claim 12 wherein the step of transmitting a request for a PSD audit from said meter server comprises the steps of:

transmitting said request for a PSD audit to said host; and transmitting said request for a PSD audit from said host to said PSD.

* * * * *